United States Patent [19]

Barber

[11] Patent Number: 4,980,943

[45] Date of Patent: Jan. 1, 1991

[54] CLEANING GLOVE

[75] Inventor: John E. Barber, New Hope, Pa.

[73] Assignee: Stockwell Group, Inc., Middleburg, Va.

[21] Appl. No.: 354,392

[22] Filed: May 18, 1989

[51] Int. Cl.[5] ..... A47L 13/18

[52] U.S. Cl. ..... 15/227; 2/158

[58] Field of Search ..... 15/104.94, 227; 401/7; 2/158, 159

[56] References Cited

U.S. PATENT DOCUMENTS 2,101,027 12/1937 Karger ..... 15/227

FOREIGN PATENT DOCUMENTS 2625 of 1911 United Kingdom ..... 15/227

*Primary Examiner*—Edward L. Roberts

*Attorney, Agent, or Firm*—Spencer & Frank

[57] ABSTRACT

A cleaning glove which includes a glove base having a side to which there is attached a primary layer of a tufted blended yarn tufted to the glove base and one or more fibrous bristle portions or strips. The blended yarn is made by weaving together three or more individual yarns including one yarn made of acrylic fibers, wool fibers or polyester fibers.

20 Claims, 1 Drawing Sheet

CLEANING GLOVE

FIELD OF THE INVENTION

The invention relates to a cleaning glove for the cleaning of soiled surfaces, such as glass, metal, plastic and textile surfaces.

TECHNOLOGY REVIEW

A deficiency in previous cleaning gloves is that dirt is often not fully retained within the glove after cleaning, so that dirt is transferred from the glove to surfaces of objects the glove subsequently rubs against.

SUMMARY OF THE INVENTION

It is therefore an object of the present invention to provide a cleaning glove with good scrubbing properties that better retains dirt within the surface of the glove.

The present invention provides a cleaning glove which includes a glove base having a side to which there is attached a primary layer of a tufted blended yarn and one or more fibrous bristle portions or strips. The blended yarn is made by weaving together three or more different individual yarns including one yarn made of acrylic fibers, wool fibers or polyester fibers.

DESCRIPTION OF THE PREFERRED EMBODIMENTS

Figure 1:
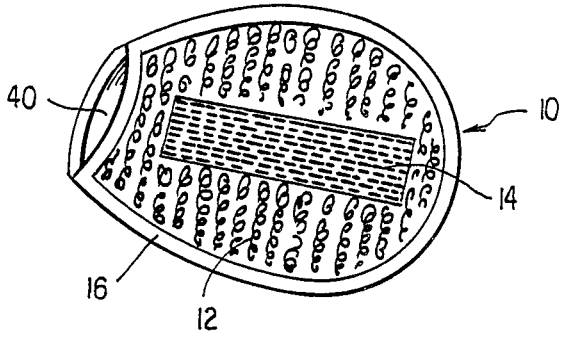
FIG. 1 is a perspective view of an embodiment of the invention.
Figure 2:
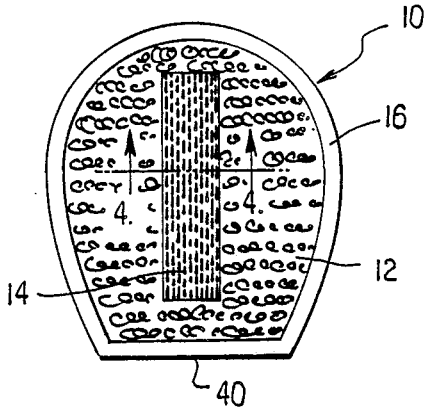
FIG. 2 is a plan view of one side of the glove shown in FIG. 1.
Figure 3:
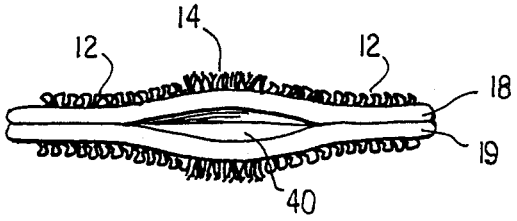
FIG. 3 is an end-on view of the glove of FIGS. 1 and 2.
Figure 4:
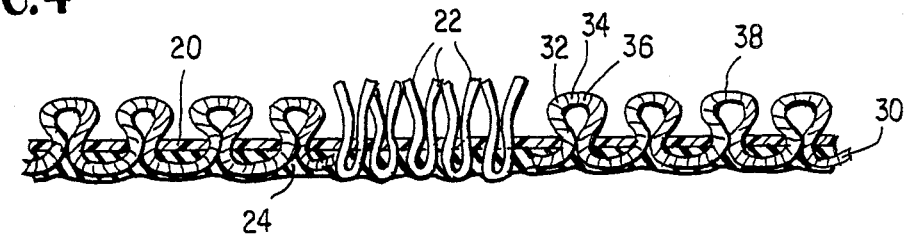
FIG. 4 is a sectional view on the line 4—4 of FIG. 1.

The cleaning glove of this invention generally has an envelope-type configuration or body intended to be worn on a user's hand or a similar shaped mechanical device. Although the glove 10 shown is oblong in shape, it may be shaped as a circular disk or other suitable shapes. While the glove 10 may be of unitary construction, the glove shown consists of two sides 18 and 19 which are attached to each other. A primary yarn layer 12 and a fibrous bristle portion or strip 14 may be attached to only one side of the glove 10, but preferably each side of the glove 10 includes a primary yarn layer 12 and a fibrous bristle portion 14.

As shown in the drawings, the glove of this invention has a pocket shaped structure and has an opening 40 for receiving a user's hand or other support. While the embodiment shown is designed to be worn on the hand, the glove can also be used at the end of the arm of a mechanical cleaning device which simulates hand cleaning. As shown in the drawings, the glove 10 is generally substantially flat.

Preferably the opening 40 is smaller in width than the diameter pocket-shaped body of the glove 10. The purpose of making the opening 40 this small is to prevent the user's hand from easily slipping out of the glove 10.

In one embodiment of the invention, the glove 10 has a base sheet of material 20 which is preferably made of a synthetic fabric such as Sub-strat-brand modular rayon drill. A typical base material has a "basket-weave" design and has 21 pick ends per inch in one direction and 19 pick ends per inch in the other direction. To achieve good wearability, the base material is preferably at least 2500 denier in weight. The base material is preferably made of synthetic fibers to increase shrink resistance upon washing. Suitable synthetic fibers from which the base material may be woven include rayon, or other synthetic fibers such as polyolefins, polypropylene, nylon etc. which are resistant to shrinking when exposed to hot water or heat.

A primary layer 12 of a blended yarn 30 is tufted to the base material 20 by conventional tufting machines such as a Tuftco Model 204 (manufactured by Tuftco Corp. of Chattanooga, Tenn.) to form tufts 38. The blended yarn 30 is made up of at least three different individual yarns 32, 34 and 36 which are woven together by conventional yarn weaving methods. While the order of the yarns is not critical to the invention, for the sake of discussion, yarn 32 will represent an acrylic, a wool yarn or a polyester yarn, yarn 34 will represent a nylon yarn and yarn 36 will represent rayon yarn, unless otherwise indicated.

An important feature of the invention is its superior dirt retention which results from combining an acrylic, a wool or a polyester yarn 32 with two other yarns 34 and 36. With a proper blending of yarns in the blended yarn 30, a glove 10 can be produced which will not transfer retained dirt, even after repeated rubbings on a surface such as a carpet or a piece of clothing.

The choice of an acrylic, a wool or a polyester yarn yarn will depend on such things as cost and the particular properties desired in the finished glove. For instance, acrylic, a synthetic fiber, has better shrink resistance than wool, a natural fiber, which may be important in situations when the glove 10 is to be washed repeatedly. Also, while both acrylic and wool fibers have the property of increasing the ability of the glove 10 to pick up and retain dirt, acrylic fibers also give the glove 10 a good hand-feel. However, a disadvantage of acrylic yarn is that it does not have particularly good wearability, so other types of yarn normally make up the bulk of the blended yarn. The proportion of acrylic or wool yarn in the blended yarn is preferably about 5 to 60%.

A polyester yarn may be used in place of the acrylic or wool yarn. However, because polyester fibers do not retain soil as well as acrylic or wool fibers, the proportion of polyester needed in the combined yarn to achieve the same cleaning effect as a combined yarn including acrylic or wool is significantly greater.

The nylon yarn 34 may be considered the backbone of the blended yarn 30 because it has good durability. Other fibrous yarns with good wearability may be used in place of nylon, but nylon is a preferred durable yarn, because it is a synthetic and, therefore, exhibits good shrink resistance upon exposure to heat or hot water. The proportion of nylon in the blended yarn is preferably about 30 to 70%.

The rayon yarn 36 is preferably used in the blended yarn 30 to give the pad good moisture retention. In addition to helping pick up and retain dirt, the rayon in the pad also helps dry the carpet being cleaned. Further, rayon also has the ability to lift detergent residues from the carpet being cleaned. However, although its wearability is better than that of acrylic yarn, rayon does not have the durability of nylon. For this reason, nylon may be considered the backbone of the blended yarn, even though rayon has better absorption properties than nylon. While natural fibers with properties similar to those of rayon may be used in the blended yarn, because rayon is a synthetic fiber, it is a preferred fiber because it exhibits good shrink resistance when exposed to heat or hot water. The proportion of rayon in the blended yarn is preferably about 5 to 60%.

It has been found that using a three-fiber blend yarn which includes acrylic or wool provides better capillary attraction, i.e. better attraction of dirt into the glove 10, than single fiber yarns or two-fiber yarns. Preferably, the fibers are not dyed, because dying the fibers normally decreases their cleaning ability.

Each side of the glove 10 also includes one or more portions 14 made of fibrous bristles 22. While these portions 14 are shown as strips, the portions could be made in other shapes. Preferably, the fibrous bristles are made of polypropylene fibers in the form of a cut pile. While the bristles 22 may be the only material in the strip areas 14, preferably the bristles 22 are formed by overtufting a fibrillated polypropylene yarn over the primary layer 12 and then cutting off the top of the tufted polypropylene loops to form a cut pile. The polypropylene strips have the property of causing small amount of heat to develop in the glove 10 as it is run over the surface of a material such as a carpet. As the pad heats up, the fibers in the pad appear to open up and are found to more readily accept the dirt in the carpet, e.g. through capillary attraction. While polypropylene is the preferred material used in the bristles, other materials with similar properties could also be used. If desired, the polypropylene may be dyed.

There may for example be one lengthwise portion or strip 14 on each side of the glove, but more strips of polypropylene may be used. The maximum area of the lengthwise strips should be limited to not more than about 30% of the surface area of a side, preferably about 10 to 20% of the surface area of a side. A glove with too much polypropylene on its surface may generate too much heat when used, and thereby interfere with the cleaning action. It is also desirable to limit the amount of polypropylene used because it increases the weight of the glove 10.

Preferably, the cut piles 22 are at least about 3 mm (⅛") inch higher than the height of the primary layer loops 38. Most preferably, the cut piles 22 are about 13 mm (½" inch) high and the primary layer loops 38 are about 10 mm (⅜") high.

A rubber backing 24 made of natural rubber or latex may be applied to the back of each side of the glove 10 to increase stability of the glove 10, to hold in the tufted yarn 30 and provide good hand-feel. The backing can be set by applying rubber to the back of each side of the glove 10 and curing the rubber for about 1 hour at about 127° to about 138° C. (260° to 280° F). Other materials may be used as the backing, but preferred materials are water resistant so that the glove 10 can stand up to repeated washings.

The edge of the glove may be sewn by conventional means to form a border 16. Preferably, the edge is sewn by an overedging technique to prevent the glove 10 from unravelling. The two sides 18 and 19 of the glove can be attached to each other by conventional means, such as sewing the sides together at their borders 16. Preferably, the thread used in both securing the edges of the glove 10 and to sew the two sides 18 and 19 of the glove 10 together is a synthetic thread, such as polyester thread.

Preferably, synthetic materials are used throughout the glove 10 to increase its resistance to shrinking upon being exposed to heat or hot water. The use of synthetics also prevents shedding of the glove 10 on the material being cleaned.

It is understood that various other modifications will be apparent to and can readily be made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A cleaning glove comprising:

a glove base comprising a base material, said glove base having an opening for receiving a user's hand and two sides, at least one said side including:

a primary layer comprising a blended yarn attached to said side by tufting, said blended yarn including at least three different individual yarns wherein at least one of said individual yarns comprises fibers selected from the group consisting of acrylic fibers, wool fibers and polyester fibers; and at least one portion of fibrous bristles attached to said side, said fibrous bristles extending substantially vertically from said side.

2. A cleaning glove according to claim 1, wherein at least one of said yarns comprises nylon fibers.

3. A cleaning glove according to claim 1, wherein at least one of said yarns comprises rayon fibers.

4. A cleaning glove according to claim 1, wherein at least one of said yarns is comprises acrylic fibers.

5. A cleaning glove according to claim 4, wherein said acrylic fibers comprise about 5 to 60% of said blended yarn.

6. A cleaning glove according to claim 1, wherein at least one of said yarns comprises wool fibers.

7. A cleaning glove according to claim 6, wherein said wool fibers comprise about 5 to 60% of said blended yarn.

8. A cleaning glove according to claim 1, wherein said blended yarn is comprised of about 30 to 70% nylon fibers, about 5 to 60% rayon fibers and about 5 to 60% acrylic fibers.

9. A cleaning glove according to claim 1, wherein said blended yarn is comprised of about 30 to 70% nylon fibers, about 5 to 60% rayon fibers and about 5 to 60% wool fibers.

10. A cleaning glove according to claim 1, wherein said at least portion of fibrous bristles comprises a central lengthwise strip which extends from said opening end of said glove to the opposite end of said glove.

11. A cleaning glove according to claim 1, wherein said fibrous bristles comprise polypropylene.

12. A cleaning glove according to claim 11, wherein said fibrous bristles comprise about 10 to 20% of the surface area of said side from which said fibrous bristles extends.

13. A cleaning glove according to claim 1, wherein said fibrous bristles comprise a cut pile.

14. A cleaning glove according to claim 1, wherein said radial strip comprises cut pile, said primary layer comprises tufted loops, and said cut pile is at least about 3 mm higher than said tufted loops.

15. A cleaning glove according to claim 14, wherein said cut pile is about 13 mm high and said tufted loops are about 10 mm high.

16. A cleaning glove according to claim 1, wherein said base material comprises a modular rayon drill.

17. A cleaning glove according to claim 16, wherein said modular rayon drill is at least 2500 denier.

18. A cleaning glove according to claim 1 further comprising a rubber backing deposited on the back of said side from which said fibrous bristles extend.

19. A cleaning glove according to claim 1, wherein each of said sides include a primary layer and a strip of fibrous bristles.

20. A cleaning glove according to claim 1, wherein said two sides comprise separate sheets of said base material which are attached to each other.

* * * * *